US011001942B2

(12) United States Patent
Frey et al.

(10) Patent No.: US 11,001,942 B2
(45) Date of Patent: May 11, 2021

(54) APPARATUS FOR MAKING SPUNBONDED NONWOVEN FROM CONTINUOUS FILAMENTS

(71) Applicants: Detlef Frey, Niederkassel (DE); Tristan Tiedt, Cologne (DE); Michael Nitschke, Koenigswinter (DE); Martin Neuenhofer, Roesrath (DE); Hans-Georg Geus, Niederkassel (DE)

(72) Inventors: Detlef Frey, Niederkassel (DE); Tristan Tiedt, Cologne (DE); Michael Nitschke, Koenigswinter (DE); Martin Neuenhofer, Roesrath (DE); Hans-Georg Geus, Niederkassel (DE)

(73) Assignee: REIFENHAEUSER GMBH & CO. KG MASCHINENFABRICK, Troisdorf (DE)

( * ) Notice: Subject to any disclaimer, the term of this patent is extended or adjusted under 35 U.S.C. 154(b) by 0 days.

(21) Appl. No.: 16/423,048

(22) Filed: May 27, 2019

(65) Prior Publication Data

US 2019/0360123 A1 Nov. 28, 2019

(30) Foreign Application Priority Data

May 28, 2018 (EP) ..... 18174523

(51) Int. Cl.
*D01D 5/092* (2006.01)
*D04H 3/16* (2006.01)

(52) U.S. Cl.
CPC ..... *D01D 5/092* (2013.01); *D04H 3/16* (2013.01); *D10B 2321/022* (2013.01); *D10B 2331/04* (2013.01)

(58) Field of Classification Search
CPC ..... D01D 5/088; D01D 5/092; D01D 5/098; D04H 3/16
See application file for complete search history.

(56) References Cited

U.S. PATENT DOCUMENTS 2,982,994 A * 5/1961 Fernstrom ..... D01D 5/092 264/211.17
4,631,018 A * 12/1986 Valteris ..... D01D 5/092 425/445

(Continued)

*Primary Examiner* — Xiao S Zhao
*Assistant Examiner* — Joseph S Leyson
(74) *Attorney, Agent, or Firm* — Andrew Wilford

(57) ABSTRACT

An apparatus for making spunbonded nonwoven has a spinneret for emitting the continuous filaments in a filament-travel direction, a cooling chamber downstream in the direction from the spinneret and receiving the filaments, and two air-supply manifolds flanking the chamber for feeding cooling air thereinto transverse to the direction. A flow straightener for equalizing flow of the cooling air on the filaments is provided in at least one of the air-supply manifolds and has passage walls forming a plurality of flow passages that extend transversely to a filament-travel direction. A flow cross section of the flow straightener is greater than 85% (preferably more than 90%) of a cross-sectional size of the straightener, a ratio of a length L of the flow passages to an inner diameter $D_i$ of the flow passages $L/D_i$ is 1 to 15.

11 Claims, 3 Drawing Sheets

(56) References Cited

U.S. PATENT DOCUMENTS

| | | | | |
|---|---|---|---|---|
| 5,700,490 | A * | 12/1997 | Meise | D01D 5/092 425/72.2 |
| 6,168,406 | B1 * | 1/2001 | Tseng | D01D 5/088 425/378.2 |
| 2009/0026647 | A1 * | 1/2009 | Geus | D01D 5/14 264/40.6 |

* cited by examiner

APPARATUS FOR MAKING SPUNBONDED NONWOVEN FROM CONTINUOUS FILAMENTS

FIELD OF THE INVENTION

The present invention relates to the manufacture of spunbonded nonwoven. More particularly this invention concerns an apparatus for making spunbonded nonwoven from continuous filaments.

BACKGROUND OF THE INVENTION

A known apparatus for making spunbonded nonwovens from continuous filaments, particularly from continuous thermoplastic filaments, comprises a spinneret for spinning the continuous filaments, a cooling chamber for cooling the spun filaments with cooling air, a respective air-supply manifold is provided on each of the opposing sides of the cooling chamber for feeding cooling air into the cooling chamber from the respective oppositely situated air-supply manifolds, and flow straighteners in the air-supply manifolds for equalizing the cooling air fed from the air-supply manifolds.

In the context of the invention, "spunbonded nonwoven" refers particularly to a spunbond fabric that is made by the spunbond process. Continuous filaments differ from staple fibers by of their quasi endless length, whereas staple fibers have much shorter lengths of 10 mm to 60 mm, for example.

Various versions of the apparatus of the type described above are known from practice. Many of these known apparatuses have the disadvantage that the spunbonded nonwovens made with them are not always sufficiently homogeneous over their entire surface. Many spunbonded nonwovens have objectionable inhomogeneities shaped as imperfections or defects. The number of inhomogeneities generally increases as the throughput and/or yarn speed increases. One typical imperfection in such spunbonded nonwovens is caused by so-called "drops." These arise as a result of the tearing-off of one or more soft or molten filaments, resulting in a melt accumulation that causes a defect in the spunbonded nonwoven. Such imperfections usually have a size of greater than 2 mm by 2 mm. Imperfections in the spunbonded nonwovens can also be made as a result of so-called "hard pieces." These arise as follows: As a result of tension loss, a filament can relax, snap back, and form a ball that creates the defect in the spunbonded nonwoven surface. Such imperfections are usually smaller than 2 mm by 2 mm. Many spunbonded nonwovens or spunbonded fleeces made by known processes exhibit such inhomogeneities, especially if high throughputs are used in their production.

OBJECTS OF THE INVENTION

It is therefore an object of the present invention to provide an improved apparatus for making spunbonded nonwoven from continuous filaments.

Another object is the provision of such an improved apparatus for making spunbonded nonwoven from continuous filaments that overcomes the above-given disadvantages, in particular with which highly homogeneous spunbonded nonwovens can be made that are at least largely free of imperfections or defects, especially at higher throughputs of greater than 200 kg/h/m and/or at high yarn speeds.

SUMMARY OF THE INVENTION

An apparatus for making spunbonded nonwoven has according to the invention a spinneret for emitting the continuous filaments in a filament-travel direction, a cooling chamber downstream in the direction from the spinneret and receiving the filaments, and two air-supply manifolds flanking the chamber for feeding cooling air thereinto transverse to the direction. A flow straightener for equalizing flow of the cooling air on the filaments is provided in at least one of the air-supply manifolds and has passage walls forming a plurality of flow passages that extend transversely to a filament-travel direction. A flow cross section of the flow straightener is greater than 85% (preferably more than 90%) of a cross-sectional size of the straightener, a ratio of a length L of the flow passages to an inner diameter $D_i$ of the flow passages $L/D_i$ is 1 to 15, preferably 1 to 10, and more preferably 1.5 to 9.

It is recommended that the flow cross section of a flow straightener be greater than 91%, preferably greater than 92%, and especially preferably greater than 92.5%. The flow cross section of the flow straightener refers particularly to the unobstructed flow cross section of the flow straightener and is thus not restricted by the passage walls or the thickness of the passage walls and/or any spacers that may be provided between the flow passages or the passage walls. No flow filters in the vicinity of the flow straightener and, above all, flow screens with their meshes upstream or downstream from the flow straightener are considered in the calculation of the flow cross section. Advantageously, these flow screens or similar components are disregarded in the calculation of the flow cross section. It is recommended that the flow cross section of a flow straightener be calculated merely by adding up the open subareas of all flow passages relative to the total surface area of the flow straightener. This flow cross section as well as the total surface area of the flow straightener extends transverse, particularly perpendicular or substantially perpendicular to the flow passages and thus is a cross-sectional area of the flow straightener.

$D_i$ refers to the inner diameter of the flow passages. It is thus measured for a flow passage from a passage wall to an opposite passage wall. If a flow passage has different diameters with respect to its cross-section, $D_i$ refers particularly to the smallest inner diameter of the flow passage. "Smallest inner diameter $D_i$" thus refers here and in the following to the smallest inner diameter measured in a flow passage if this flow passage has different inner diameters with respect to its cross section. Thus, in the case of a cross section shaped as a regular hexagon, the smallest inner diameter is measured between two opposite sides and not between two opposite corners. It is recommended that the ratio of the length L of the flow passages to the inner diameter $D_i$ of the flow passages $L/D_i$ be 2 to 8, preferably 2.5 to 7.5, more preferably 2.5 to 7, and very preferably 3 to 6.5. According to an especially recommended embodiment, the ratio $L/D_i$ is 4 to 6, particularly 4.5 to 5.5. If different lengths L of the flow passages and/or different inner diameters $D_i$ or smallest inner diameters $D_i$ of the flow passages exist among a plurality of flow passages, L refers to the mean length and/or $D_i$ refers to the mean inner diameter or smallest inner diameter.

Here and below, "machine direction" (MD) refers to the direction in which the filaments that are deposited on a delivery device or on a mesh belt or the nonwoven deposit are transported away. It lies within the scope of the invention for the two air-supply manifolds and/or the flow straighteners to extend transverse to the machine direction (CD direction) and for the cooling air to thus be introduced substantially in the machine direction (MD) or counter to the machine direction.

The flow straighteners according to the invention make it possible, in particular, to achieve a uniform, homogeneous incidence of cooling air over the width of the system and/or in the CD direction. The invention is based on the discovery that, by influencing the cooling, more particularly the cooling air flow in the cooling chamber, and particularly through the special configuration of the flow straightener, a very effective equalization of the filament deposit or fleece deposit is achieved. Due to the cooling according to the invention, and particularly by virtue of the design of the flow straightener, it is possible to produce surprisingly homogeneous spunbonded nonwovens that are largely free of imperfections or defects. Above all, this also applies to higher throughputs and higher yarn speeds as specified in greater detail below.

It lies within the scope of the invention for the cooling air supply for the cooling chamber to be achieved through suction of the cooling air due to the filament movement and/or the downward filament flow and/or by active injection or introduction of cooling air, for example by at least one blower. The flow straighteners according to the invention are intended to bring about a directional blowing of the filaments, advantageously a blowing transverse, preferably perpendicular to the filament axis or to the filament-travel direction. It also lies within the scope of the invention for the flow straighteners to ensure uniform or homogeneous incidence of cooling air on the filaments. Here, "incidence of cooling air on the filaments" preferably means a homogeneous or uniform flow over the width of the apparatus transverse to the machine direction, i.e. in the CD direction. In principle, the incidence of flow over the height of the cooling air chamber or of the flow straighteners can be different. It is recommended that the flow straighteners according to the invention provide in particular for a uniform alignment of the air flow vectors, with the level of air speed advantageously remaining largely unchanged. In particular, the inventive configuration of the flow straightener fulfills the above-described effect of a uniform or directed incidence of cooling air on the filaments in the cooling chamber. According to a preferred embodiment, equal or substantially equal volume flows of cooling air are introduced into the cooling chamber from both oppositely situated air-supply manifolds. In principle, however, it also lies within the scope of the invention for different volume flows of cooling air to be introduced into the cooling chamber from each of the two air-supply manifolds.

One advantageous embodiment of the invention is characterized in that each air-supply manifold is subdivided into at least two sections from each of which cooling air of different temperature can be fed. It is recommended that each air-supply manifold have two sections provided one above the other or vertically one above the other from which the cooling air of different temperature is supplied. Advantageously, cooling air of the same temperatures is introduced into the cooling chamber from two opposing sections of two air-supply manifolds. According to a preferred embodiment of the invention, each air-supply manifold is subdivided into only two sections from each of which cooling air of a different temperature can be emitted. According to another embodiment, an air-supply manifold has three or more sections from which cooling air of different temperature can be introduced into the cooling chamber. Preferably, a flow straightener is provided in each section of the air-supply manifolds. Advantageously, a flow straightener extends over all of the sections of an air-supply manifold. According to a preferred embodiment, a flow straightener extends over the entire height and/or width of the associated air-supply manifold or substantially over the entire height and/or width of the associated air-supply manifold.

One especially recommended embodiment of the invention is characterized in that at least one flow straightener has at least one flow screen on its cooling air intake side and/or on its cooling air output side. It lies within the scope of the invention for a flow screen, more particularly the surface of the flow screen, to extend perpendicular or substantially perpendicular to the longitudinal direction of the flow passages of the flow straightener. It is recommended that a flow straightener have such a flow screen both on its cooling air intake side and on its cooling air output side. Advantageously, a flow screen is clamped or held or fastened under prestress on the cooling air intake side and/or on the cooling air output side of a flow straightener. It lies within the scope of the invention for the flow screen to be provided on or rest directly against the flow straightener on the cooling air intake side and/or on the cooling air output side of the flow straightener. With the flow screens that are preferably provided, the intention is to ensure the homogeneous incidence of flow of the cooling air on the filaments. It lies within the scope of the invention for the flow screens upstream and downstream of the flow straightener to not be considered in determining the flow cross section of the flow straightener that is discussed above and defined in claim 1.

It is recommended that a flow screen have a mesh size or a mean mesh size of from 0.1 to 0.5 mm, advantageously from 0.1 to 0.4 mm, and preferably from 0.15 to 0.34 mm. Here, "mesh size" refers particularly to the spacing between two opposing wires of the flow screen or of the screen fabric of the flow screen. "Mesh size" refers more particularly to the shortest spacing between two oppositely situated wires of a mesh. If a flow screen has rectangular meshes with rectangular sides of different lengths, "mesh size" is the spacing between the two longer sides of the rectangle. It is recommended that a flow screen have a wire thickness or mean wire thickness of from 0.05 to 0.35 mm, preferably from 0.05 to 0.32 mm, more preferably from 0.06 to 0.30 mm, and very preferably from 0.07 to 0.28 mm. It lies within the scope of the invention for a flow screen to have identical or meshes all of the same size or substantially identical or equally sized meshes over its screen surface. It is advantageous if a homogeneous distribution of meshes of the same geometry or of substantially the same geometry exists over the screen surface.

According to the recommended embodiment of the invention, the flow cross section of a flow screen is 15 to 55%, preferably 20 to 50%, and more preferably 25 to 45%. The flow cross section of the flow screen refers in particular to the open area of the flow screen that is not blocked by the mesh wires and thus the area of the flow screen through which the cooling air can freely flow.

A preferred embodiment of the invention is characterized in that a flow straightener and a flow screen that is on the cooling air intake side and/or on the cooling air output side thereof are received by a common frame. This creates, as it were, a secure or stable bond between the flow straightener and the flow screens that can be fixed in place as a whole in the air-supply manifold. Preferably, at least one such frame with a flow straightener and at least one flow screen is provided on both opposite sides of the cooling chamber or on both air-supply manifolds.

According to the invention, the flow passages of the flow straightener or flow straighteners extend transverse to the filament-travel direction and advantageously transverse to the longitudinal central axis M of the apparatus. According to a preferred embodiment of the invention, the flow passages are oriented perpendicular or substantially perpendicular to the filament-travel direction or to the longitudinal central axis M of the apparatus. It lies within the scope of the invention for the flow passages to be aligned perpendicular or substantially perpendicular to a plane that is oriented orthogonal to the machine direction (MD) or to a vertical plane running through the longitudinal central axis M of the apparatus. In principle, it is also possible for the flow passages to extend at an acute angle to the above-described planes. The acute-angle orientations of the flow passages of a flow straightener can be uniform or also different. When mention is made here to the orientation or arrangement of the flow passages, this is referring particularly to the orientation or arrangement of the longitudinal axes of the flow passages. It lies within the scope of the invention for the flow passages of a flow straightener to be straight or substantially straight.

One very preferred embodiment of the invention is characterized in that the flow passages of a flow straightener are of polygonal cross section, particularly a square to octagonal cross section. One highly recommended embodiment of the invention is characterized in that the flow passages of the flow straightener are provided with a hexagonal cross section. For this preferred case, the flow passages are thus configured in a honeycomb shape.

According to another preferred embodiment of the invention, the flow passages of a flow straightener are of round cross section, in which case the flow passages preferably have a circular or oval-shaped cross section. The circular cross section is preferred, however.

An additional embodiment of the invention is characterized in that the passage walls of the flow passages have the shape of a wing or airfoil. In particular, the airfoil-shaped passage walls carry out a directional function with respect to the cooling air flowing through. Rectangular or substantially rectangular flow passages are advantageously formed between the wing-shaped or airfoil-shaped passage walls. It lies within the scope of the invention for the smallest spacing between two adjacent wing-shaped or airfoil-shaped passage walls to be 2 to 15 mm, preferably 3 to 12 mm, and more preferably 5 to 10 mm.

One highly recommended embodiment of the invention is characterized in that the inner surface of a flow straightener through which the cooling air flows constitutes 5 to 50 $m^2$, preferably 7.5 to 45 $m^2$, and more preferably 10 to 40 $m^2$ per square meter of flow cross section of the flow straightener. The inner surface through which the cooling air flows is calculated from the sum of the areas of the passage walls of the flow passages through and/or against which flow occurs per square meter of flow cross section. It lies within the scope of the invention for the flow screens of the flow straightener to be left out when calculating the flow cross section.

According to a very preferred embodiment of the invention, the length L of the flow passages of a flow straightener is 15 to 65 mm, preferably 20 to 60 mm, more preferably 20 to 55 mm, and very preferably 25 to 50 mm. Recommendably, the inner diameter or the smallest inner diameter $D_i$ of the flow passages is 2 to 15 mm, preferably 3 to 12 mm, more preferably 4 to 11 mm, and very preferably 5 to 10 mm. It lies within the scope of the invention for the flow passages to be compact and closely juxtaposed next to one another in a flow straightener. Preferably, flow passage adjoins the flow passage in a flow straightener, and, according to one embodiment, it is possible for only spacers to be present between the flow passages. It is recommended that the mutual spacing between the flow passages or at least the majority of the flow passages be less than or substantially less than the smallest inner diameter $D_i$ of a flow passage. Advantageously, the flow passages are grouped in a flow straightener according to the principle of closest packing.

It lies within the scope of the invention for at least one conduit for the supply of cooling air having a cross-sectional area QZ to be connected to each air-supply manifold, this cross-sectional area QZ of the conduit being enlarged as the cooling air passes into the air-supply manifold to a cross-sectional area QL of the air-supply manifold, the cross-sectional area QL being at least twice as large, preferably at least three times as large and more preferably four times as large as the cross-sectional area QZ of the conduit. It is advantageous for the cross-sectional area QZ of the conduit to be increased to 3 to 15 times the cross-sectional area QL of the air-supply manifold. According to one embodiment of the invention, the cooling stream supplied to an air-supply manifold is divided into a plurality of substreams that enter separate sub-conduits and/or through branches of a split conduit. Particularly, the cooling air volume flow can be divided into two to five, preferably into two to three substreams. If each substream enters through a separate conduit branch, the cross-sectional area QZ of the conduit branch is enlarged to the cross-sectional area QL of the relevant section of the air-supply manifold. The cross-sectional area QL is preferably at least twice as large and more preferably at least three times as large as the cross-sectional area QZ of the conduit branch. It is recommended that the cross-sectional area QZ of a conduit or of a conduit branch increase stepwise, particularly in a plurality of stages, or continuously to the cross-sectional area QL of the air-supply manifold or to the cross-sectional area of a section of the air-supply manifold.

According to an especially recommended embodiment of the invention, at least one planar homogenizing element for homogenizing the cooling air flow introduced into the air-supply manifold is provided in the air-supply manifold in the filament-travel direction of the cooling air upstream from the flow straightener and at a spacing from the flow straightener. It lies within the scope of the invention for a planar homogenization element to have a plurality of openings and for the free-flow cross section of the planar homogenizing element to constitute 1 to 20%, preferably 2 to 18%, and more preferably 2 to 15% of the total surface area of the planar homogenizing element. According to a design variant, at least one homogenizing element is perforated, particularly is a perforated plate, with a plurality of holes, the holes preferably each having an opening diameter of from 1 to 10 mm, more preferably from 1.5 to 9 mm, and very preferably from 1.5 to 8 mm. According to another preferred embodiment of the invention, a homogenizing element is embodied as a homogenizing screen with a plurality or with a multitude of meshes, the homogenizing screen preferably having mesh sizes of from 0.1 to 0.5 mm, more preferably from 0.12 to 0.4 mm, and very preferably from 0.15 to 0.35 mm. It is recommended that the planar homogenizing element be provided at a spacing al of at least 50 mm, preferably of at least 80 mm, and more preferably of at least 100 mm upstream from the flow straightener of the corresponding air-supply manifold or upstream from the flow screen of this flow straightener in the flow direction of the cooling air. Advantageously, a plurality of homogenizing elements are provided in succession at a spacing from the flow straightener in the flow direction of the cooling air so as to be spaced apart from one another in an air-supply manifold. The spacing between two homogenizing elements that are provided in direct succession in an air-supply manifold in the flow direction is at least 50 mm, preferably at least at least 80 mm, and more preferably at least 100 mm.

In the apparatus according to the invention, the continuous filaments are emitted by a spinneret and supplied to the cooling chamber with the air-supply manifolds and flow straighteners. It lies within the scope of the invention for at least one spinning beam for spinning the filaments to extend in the machine direction (MD direction). According to a very preferred embodiment of the invention, the spinning beam is oriented perpendicular or substantially perpendicular to the machine direction. It is also possible, however, and lies within the scope of the invention for the spinning beam to extend at an acute angle to the machine direction. According to a very preferred embodiment of the invention, at least one monomer extractor is provided between the spinneret or spinning beam and the cooling chamber. With the monomer extractor, air is sucked out of the filament formation region below the spinneret. This enables the gases emanating from the continuous filaments, such as monomers, oligomers, decomposition products, and the like, to be removed from the apparatus according to the invention. A monomer extractor advantageously has at least one extraction chamber to which the intake of the preferably at least one extraction blower is connected. It is recommended that the cooling chamber according to the invention with the air-supply manifolds and flow straighteners adjoin the monomer extractor in the flow direction of the filaments.

It lies within the scope of the invention for the filaments to be fed from the cooling chamber into a stretcher for elongating the filaments. Advantageously, an intermediate passage adjoins the cooling chamber and connects the cooling chamber to a tunnel of the stretcher.

According to an especially preferred embodiment of the invention, the subassembly of the cooling chamber and the stretcher or the subassembly of the cooling chamber, the intermediate passage, and the tunnel is embodied as a closed system. "Closed system" means particularly that, apart from the supply of cooling air into the cooling chamber, no further air supply takes place in this unit. The flow straighteners that are used according to the invention are distinguished, above all, by special advantages in such a closed system. An especially simple and effective equalization of the air flow, more particularly of the cooling air flow, is possible here.

Preferably, at least one diffuser follows the stretcher in the flow direction of the filaments, the filaments being guided through this diffuser. It is recommended that the diffuser comprise a diffuser cross section that widens in the direction of deposition of the filaments or a flaring diffuser section. It lies within the scope of the invention for the filaments to be deposited on a delivery device for depositing filaments or for depositing nonwovens. The delivery device is advantageously a mesh belt, more particularly a foraminous mesh belt. The nonwoven web formed from the filaments is conveyed away in the machine direction (MD) with the delivery device or with the mesh belt.

According to a preferred embodiment of the invention, process air is sucked, more particularly sucked from below, through the delivery device or through the mesh belt at least in the area in which the filaments are deposited. An especially stable depositing of the filament or nonwoven is achieved in this way. This extraction has advantageous significance in the context of the invention in combination with the 1fasdfassd flow straighteners according to the invention. After deposition on the delivery device, the nonwoven web is advantageously conveyed for additional treatment measures, particularly calendering.

It lies within the scope of the invention for the apparatus according to the invention to be configured or set up with the understanding that it is possible to work at yarn speeds or filament speeds in excess of 2000 m/min, particularly at yarn speeds of over 2200 m/min or over 2500 m/min, for example at a yarn speed in the range of 3000 m/min. These filament speeds can be used in manufacture of filaments or spunbonded nonwovens made of polyolefins, particularly of polypropylene. In the course of manufacture of filaments or spunbonded nonwovens from polyesters, particularly from polyethylene terephthalate (PET), yarn speeds or filament speeds of greater than 4000 m/min and even greater than 5000 m/min can be realized with the apparatus according to the invention. For the high yarn speeds listed above, the inventive configuration of the air-supply manifolds with the flow straighteners has proven to be especially advantageous both for to polyolefins and polyester.

The invention is based on the discovery that, with the apparatus according to the invention, spunbonded nonwovens of optimal quality and above all with homogeneous properties over their surface extension can be achieved. Imperfections or defects in the nonwovens, more particularly in the nonwoven surfaces, can be completely prevented or at least largely minimized. In particular, these advantages can also be achieved at high throughputs of the apparatus of greater than 150 kg/h/m or greater than 200 kg/h/m. By virtue of the inventive configuration of the air-supply manifolds and the flow straighteners, an optimal cooling air supply into the cooling chamber is ensured, which ultimately leads to the advantageous properties of the spunbonded nonwoven web. A very uniform or homogeneous cooling air supply can be achieved in the context of the invention, and, due to this advantageous supply of cooling air, the filaments are positively influenced in that unwanted imperfections in the nonwoven web can be prevented or largely minimized. Nevertheless, the apparatus according to the invention can be realized with relatively simple and inexpensive measures. It is thus also characterized by its cost-effectiveness.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
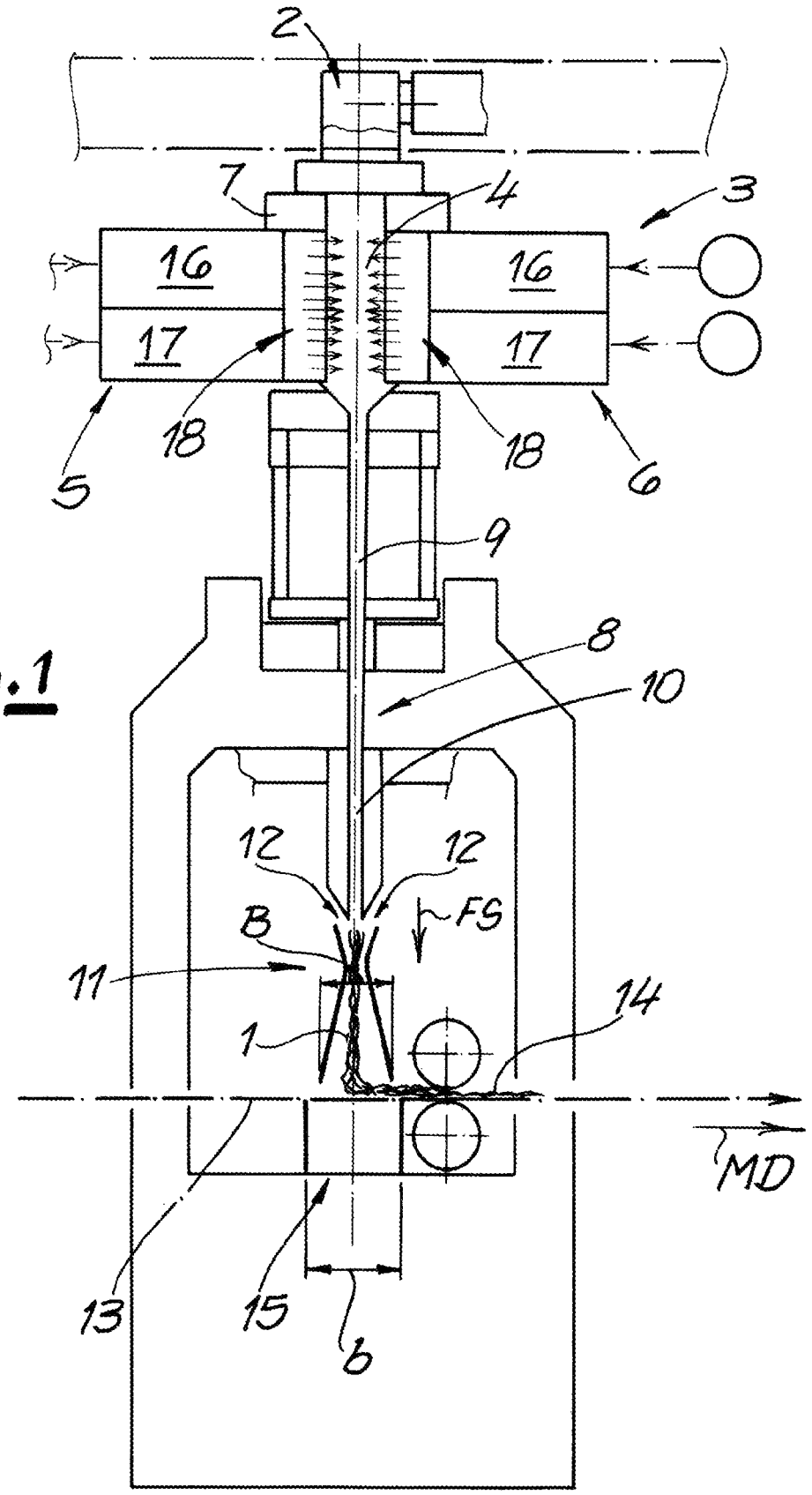
FIG. 1 is a vertical section through the apparatus according to the invention.
Figure 2:
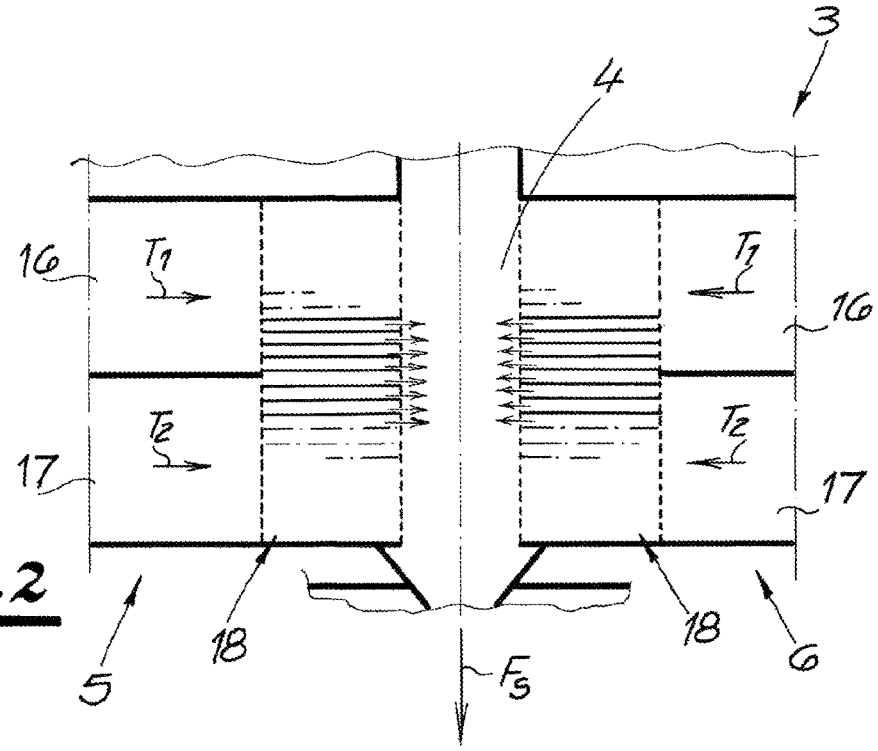
FIG. 2 is an enlarge detail from FIG. 1 showing the cooler of the cooling chamber and the air-supply manifolds.
Figure 3:
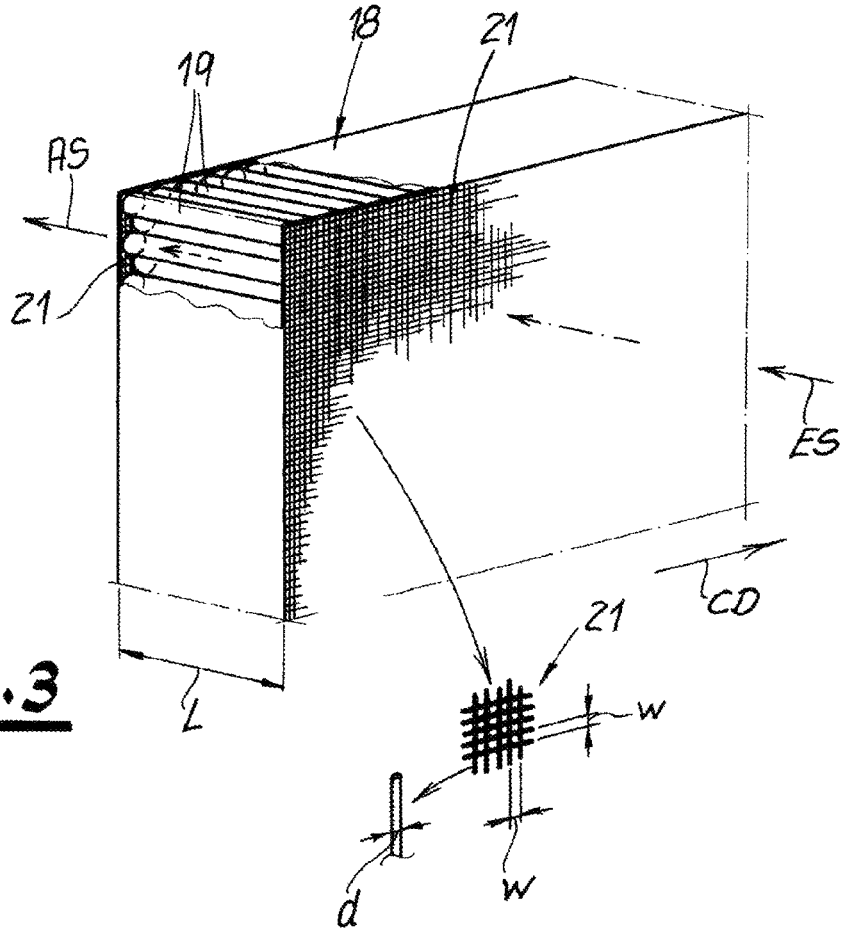
FIG. 3 is a perspective view of an subassembly of a flow straightener with upstream and downstream flow screens.

As seen in FIG. 1 an apparatus according to the invention for manufacturing spunbonded nonwovens from continuous filaments 1, particularly from continuous thermoplastic filaments 1 has a spinneret 2 for spinning the continuous filaments 1. These spun continuous filaments 1 are introduced in a vertical and downward filament-travel direction FS into a cooler 3 with a cooling chamber 4 flanked on opposite sides by air-supply manifolds 5 and 6. The cooling chamber 4 and the air-supply manifolds 5 and 6 are spaced transverse to a machine direction MD perpendicular to the direction FS and thus in the CD direction of the apparatus. Cooling air is introduced from the oppositely situated air-supply manifolds 5 and 6 into the cooling chamber 4. Preferably and here, a monomer extractor 7 is provided between the spinneret 2 and the cooler 3. With this monomer extractor 7, objectionable gases produced by the spinning process can be removed from the apparatus. These gases can be monomers, oligomers, or decomposition products and similar substances, for example.

In the filament-travel direction FS, the cooler 3 is followed by a stretcher 8 in which the filaments 1 are elongated. Preferably and here, the stretcher 8 has an intermediate passage 9 that connects the cooler 3 to a tunnel 10 of the stretcher 8. According to an especially preferred embodiment and here, the subassembly of the cooler 3 and the stretcher 8 and/or the subassembly of the cooler 3, the intermediate passage 9, and the tunnel 10 are embodied as a closed system. "Closed system" means that, apart from the supply of cooling air by the manifolds 5 and 6 to the cooler 3, no further air is fed into this subassembly.

Advantageously and here, a diffuser 11 through which the filaments 1 are guided adjoins the stretcher 8 in the filament-travel direction FS. According to one embodiment and here, secondary air inlet gaps 12 are provided between the stretcher 8 and/or between the tunnel 10 and the diffuser 11 for the introduction of secondary air into the diffuser 11. Preferably and here, after passing through the diffuser 11, the filaments 1 are deposited on a delivery device that is embodied as a mesh belt 13. The deposited filaments or the nonwoven web 14 is then conveyed or transported away by the mesh belt 13 in the horizontal machine direction MD. Recommendably and here, an extractor for sucking air, more particularly process air, through the delivery device or through the mesh belt 13 is provided beneath the delivery device or beneath the mesh belt 13. For this purpose, an aspiration zone 15 is preferably provided beneath the mesh belt 13 and here beneath the downstream end of the diffuser 11. The aspiration zone 15 extends at least over a width B of the diffuser outlet. Preferably and here, a width b of the aspiration zone 15 is greater than the width B of the diffuser outlet.

According to a preferred embodiment and here, each air-supply manifold 5 and 6 is divided into upstream and downstream sections 16, 17, from each of which cooling air of different temperature can be supplied. Preferably and here, cooling air can thus be supplied from each of the upper sections 16 at a temperature $T_1$, whereas cooling air can be supplied from each of the two lower sections 17 at a temperature $T_2$ that is different from the temperature $T_1$. According to one embodiment and here, a flow straightener 18 is provided in each air-supply manifold 5 and 6 on the cooling chamber side that, preferably and here, extends over both sections 16, 17 of each air-supply manifold 5 and 6.

The two flow straighteners 18 serve to rectify the cooling air flow that is incident on the filaments 1. Preferably and here, each flow straightener 18 has a plurality of flow passages 19 for this purpose that are oriented perpendicular to the filament-travel direction FS. These flow passages 19 are each delimited by passage walls 20 and are preferably straight and each emit a perfectly horizontal substream of cooling air.

According to a preferred embodiment and here, the flow cross section of each flow straightener 18 constitutes greater than 90% of the total area of the flow straightener 18. Recommendably and here, the ratio of the length L of the flow passages 19 to the smallest inner diameter $D_i$ of the flow passages 19 lies in the range between 1 and 10, advantageously in the range between 1 and 9.

According to a very advantageous embodiment and here, each flow straightener 18 has a flow screen 21 both on its outer cooling-air intake side ES and on its inner cooling-air output side AS. Preferably and here, the two flow screens 21 of each flow straightener 18 are provided directly in front of or behind the flow straightener 18.

Recommendably and here, the two flow screens 21 of a flow straightener 18, more particularly the surfaces of these flow screens 21 are aligned perpendicular to the longitudinal direction of the flow passages 19 of the flow straightener 18. It has proven advantageous for a flow screen 21 to have a mesh size w of from 0.1 to 0.5 mm, preferably from 0.1 to 0.4 mm, and more preferably from 0.15 to 0.34 mm. Furthermore, it is advantageous if the flow screen has a wire thickness of from 0.05 to 0.35 mm, preferably from 0.05 to 0.32 mm, and more preferably from 0.07 to 0.28 mm. It lies within the scope of the invention for the mesh size w of the flow screens 21 to be substantially smaller than the smallest inner diameter $D_i$ of the flow passages 19 of the flow straightener 18. The mesh size w of a flow screen 21 is preferably less than 1/6, very preferably less than 1/8, and especially preferably less than 1/10 of the smallest inner diameter $D_i$ of the flow passages 19. It is recommended that the flow cross section of a flow screen 21 that is not occupied by wire constitute up to 50% and preferably 25 to 45% of the total surface area of a flow screen 21.

Figure 4:
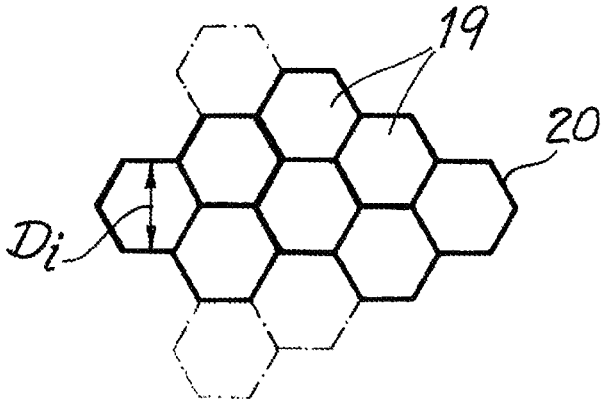
FIG. 4 is a cross section through a flow straightener section with hexagonal or honeycomb-shaped flow passages.
Figure 5:
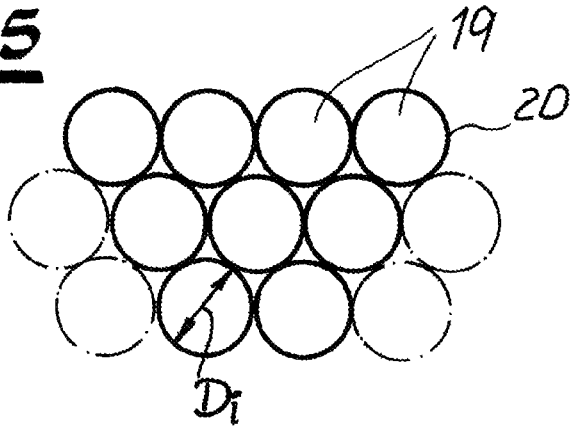
FIG. 5 is a view like FIG. 4 with circular flow passages.
Figure 6:
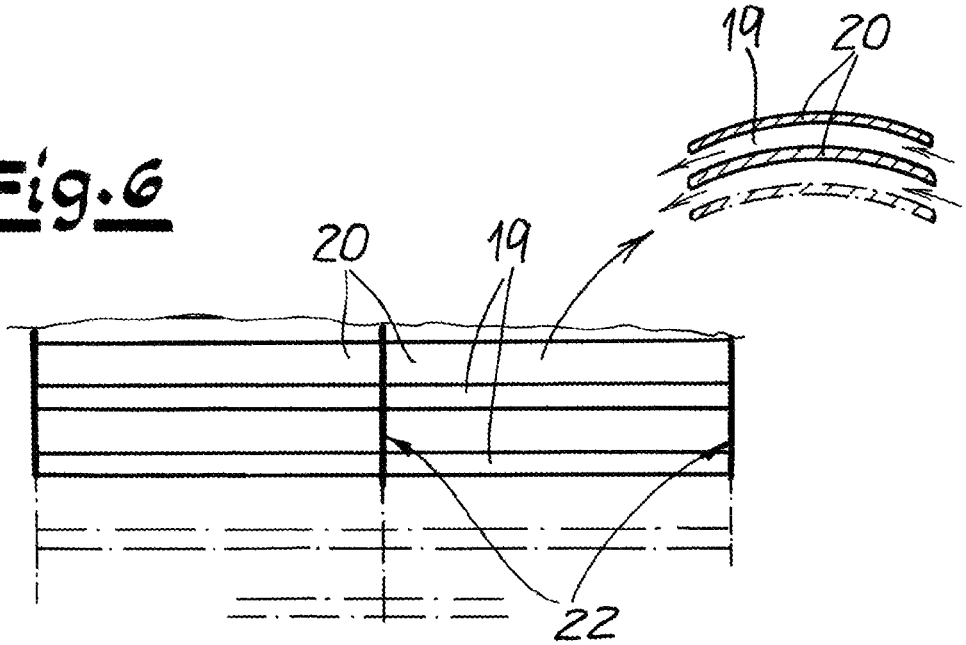
FIG. 6 is a view like FIG. 4 with airfoil-shaped passage walls of the flow passages of the flow straightener.

FIGS. 4 to 6 show typical cross sections of the flow passages 19 of a flow straightener 18 that is used according to the invention. According to a recommended embodiment and here according to FIG. 4, the flow passages 19 of a flow straightener 18 have a hexagonal or honeycomb-shaped cross section. Here, the smallest inner diameter $D_i$ is measured between opposite sides of the hexagon (see FIG. 4). In the embodiment according to FIG. 5, the flow passages 19 of the flow straightener 18 are of circular cross section. FIG. 6 shows an embodiment of a flow straightener 18 according to the invention with arcuate or airfoil-shaped passage walls 20. These airfoil-shaped passage walls 20 are advantageously separated from one another in the embodiment by spacers 22 that also form passage walls of these flow passages. The airfoil-shaped passage walls 20 are circularly arcuate segments in cross section (see right side of FIG. 6). In principle, the airfoil-shaped passage walls 20 can also be rectilinear, in which case the flow straightener 18 is a grid.

We claim:

1. An apparatus for making spunbonded nonwoven, the apparatus comprising:

a spinneret for emitting continuous filaments in a filament-travel direction;

a cooling chamber downstream in the direction from the spinneret and receiving the filaments;

two air-supply manifolds flanking the chamber for feeding cooling air thereinto transverse to the direction and each subdivided relative to the direction into an upstream section and a downstream section that feed cooling air of different temperatures to the chamber;

respective flow straighteners for equalizing flow of the cooling air on the filaments in each of the air-supply manifolds, the flow straighteners each extending in the direction along the upstream and downstream sections of the respective air-supply manifold and having passage walls extending between an intake side and an opposite outlet side of the respective straightener and forming a plurality of flow passages extending transversely to the filament-travel direction between the sides, a flow cross section of each flow straightener being greater than 85% of a cross-sectional size of the respective straightener, a ratio of a length L of the flow passages to an inner diameter Di of the flow passages L/Di of each flow straightener being 2.5:1 to 7.5:1; and a screen on each of the sides of each of the flow straighteners extending perpendicular to the passages and parallel to the direction and having a flow cross section equal to 20% to 50% of a cross-sectional size of the straightener.

2. The apparatus defined in claim 1, further comprising: a monomer extractor between the spinneret and the cooling chamber.

3. The apparatus defined in claim 1, wherein the screen has a mesh size of from 0.1 to 0.4 mm and a wire thickness of from 0.05 to 0.32 mm.

4. The apparatus defined in claim 1, wherein the flow cross section of the flow straightener is greater than 91% of a cross-sectional size of the straightener.

5. The apparatus defined in claim 1, wherein the flow passages of the flow straightener are of polygonal cross section.

6. The apparatus defined in claim 1, wherein the flow passages of the flow straightener have a round cross section.

7. The apparatus defined in claim 1, wherein the passage walls defining the passages or are wing or airfoil shaped and a spacing between two adjacent walls defining each passage is 3 to 12 mm.

8. The apparatus defined in claim 1, wherein an inner surface of the flow straightener through which the cooling air flows constitutes 5 to 50 $m^2$ of the flow cross section of the flow straightener.

9. The apparatus defined in claim 1, wherein a length of the flow passages of the flow straightener is 15 to 65 mm.

10. The apparatus defined in claim 1, wherein a smallest inner diameter of the flow passages is 2 to 15 mm.

11. The apparatus defined in claim 1, wherein the spinneret is operated such that a speed of the filaments in the filament-travel direction is greater than 2000 m/min.

* * * * *